US007400228B2

(12) United States Patent
Abeyta

(10) Patent No.: US 7,400,228 B2
(45) Date of Patent: Jul. 15, 2008

(54) RETAIL SERVICE/SERVER ANNUNCIATOR/PAGER, CENTERPIECE AND SYSTEM

(75) Inventor: Tom Abeyta, Tigard, OR (US)

(73) Assignee: Antocade, LLC, Tigard, OR (US)

( * ) Notice: Subject to any disclaimer, the term of this patent is extended or adjusted under 35 U.S.C. 154(b) by 197 days.

(21) Appl. No.: 11/313,033

(22) Filed: Dec. 19, 2005

(65) Prior Publication Data

US 2007/0139166 A1 Jun. 21, 2007

(51) Int. Cl.

| | |
|---|---|
| ***G08B 5/36*** | (2006.01) |
| ***A61G 13/04*** | (2006.01) |
| ***G09F 13/04*** | (2006.01) |
| *G08B 23/00* | (2006.01) |

(52) U.S. Cl. ..... 340/286.09; 340/286.06; 340/691.1; 340/321; 116/63 T; 116/63 P; 362/33; 362/97

(58) Field of Classification Search ..... 340/286.09, 340/286.06

See application file for complete search history.

(56) References Cited

U.S. PATENT DOCUMENTS

| | | | | |
|---|---|---|---|---|
| 4,701,849 | A * | 10/1987 | Elden | 705/11 |
| 5,489,887 | A | 2/1996 | Porras | |
| 5,699,039 | A | 12/1997 | Korzen | |
| 5,828,294 | A * | 10/1998 | Shank | 340/326 |
| 6,975,207 | B1 * | 12/2005 | Shmelzer | 340/286.09 |

* cited by examiner

*Primary Examiner*—Donnie L Crosland
(74) *Attorney, Agent, or Firm*—Ater Wynne LLP

(57) ABSTRACT

A retail customer service annunciator/pager includes a base to recline on a retail tabletop; a tapered body extending upwardly from the base; a combination switch/light adjacent the apex of the tapered body, the switch/light alternately switching a visible light on and off when the switch is manually actuated. The tapered body provides within its outer periphery one or more open compartments to store condiments. The switch/light includes a translucent or transparent lens/cover that is engraved with a company identity indicium. The tabletop annunciator/pager includes a pager including a visible light that is selectively switchable on and off; and a wireless transmitter for communicating from the tabletop annunciator/pager to a remote receiver an on-off status of the visible light. A plural channel wireless receiver responsive to plural wireless transmitters includes a processor to determine the lengths of time the lights are in an on state and a display to annunciate or record the determined lengths of time.

26 Claims, 4 Drawing Sheets

RETAIL SERVICE/SERVER ANNUNCIATOR/PAGER, CENTERPIECE AND SYSTEM

BACKGROUND OF THE INVENTION

This invention relates generally to the field of retail customer service pagers. More particularly, it concerns a tabletop centerpiece pager useful to improve promptness of service for food and/or beverage retail customers.

Coffee shops, bars, cantinas, fast-food outlets and fine dining establishments provide tables for customers to eat and imbibe. Some such tables are big enough barely for one or two customers or patrons to place their food or drinks. Often, tables are densely packed within the drinking or dining facility. It is difficult for a retail server, e.g. a waiter or waitress, to know when a customer is in need of service, whether the service involves ordering, replenishing, ticketing, clean-up or other assistance.

Tabletop 'pagers' are known to provide a mechanism for the customer to switch on a call light or visible annunciator when such service is needed. One such recent tabletop pager is described in U.S. Pat. No. 5,699,039 issued Dec. 16, 1997 and entitled ELECTRONIC TABLE PAGER AND DISPLAY DEVICE. That pager features a "menu-like" stand employing a low-energy-demand light source that is switchable on or off by the customer or server. It features a base-mounted manual switch and a separate electroluminescent (EL) surface element operating with an inverter-supplied alternating current feeding in turn a low-frequency oscillator driving the EL element to attract a waiter. The surface element frames a pair of vertical display support members extending upwardly from a base, the support members permitting a menu or advertising card to be disposed therebetween. No other functionality is provided by the prior art pager device.

SUMMARY OF THE INVENTION

The invented retail customer service annunciator/pager comprises a base configured to recline on a retail tabletop; a tapered body extending upwardly from the base; and a combination switch/light adjacent the apex of the tapered body, the switch/light configured alternately to switch a visible light on and off when the switch is manually actuated, wherein a) the tapered body is configured to provide within its outer periphery one or more open compartments configured to store condiments and/or b) the combination switch/light includes a translucent or transparent lens/cover that is engraved with a company identity indicium. The invented tabletop annunciator/pager system comprises a pager including a visible light that is selectively switchable on and off; a wireless transmitter for wirelessly communicating from the tabletop pager to a remote receiver an on-off status of the visible light; and an integral housing for the pager and the wireless transmitter, the housing being configured and sized for placement on a tabletop. Optionally the system further comprises a plural-channel wireless receiver remote from and responsive to plural wireless transmitters corresponding with plural instances of the tabletop annunciator/pager; a processor operatively proximately coupled with the wireless receiver, the processor being configured to determine the lengths of time the lights of the plural instances of the tabletop annunciator/pager are in an on state and a display mechanism coupled with the processor to annunciate or record the determined lengths of time.

DETAILED DESCRIPTION OF THE PREFERRED EMBODIMENTS

Figure 1:
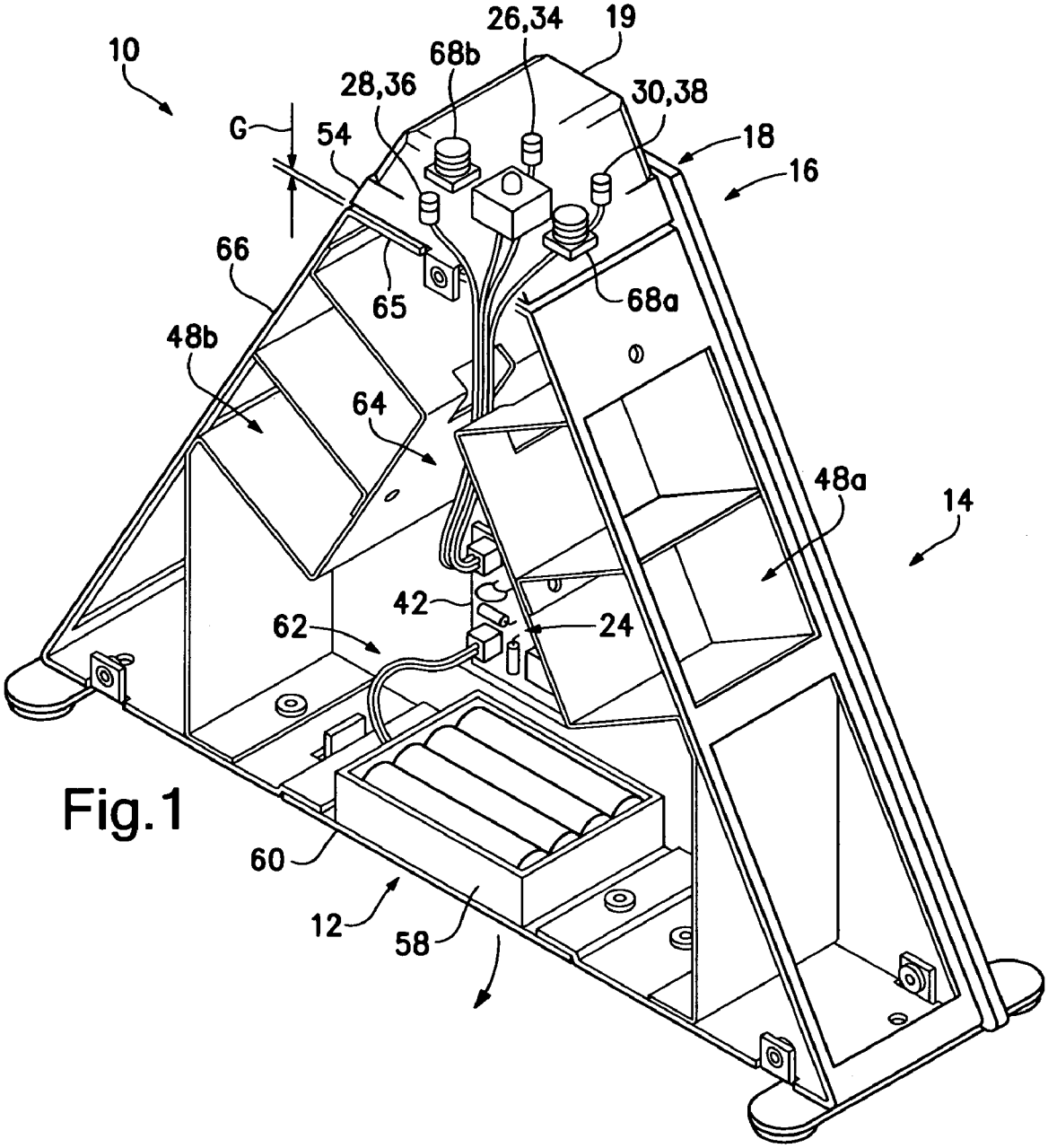
FIG. 1 is an isometric, partially cutaway view of the invented annunciator/pager in mostly assembled form, in accordance with one embodiment of the invention, with the front panel removed for clarity.
Figure 2:
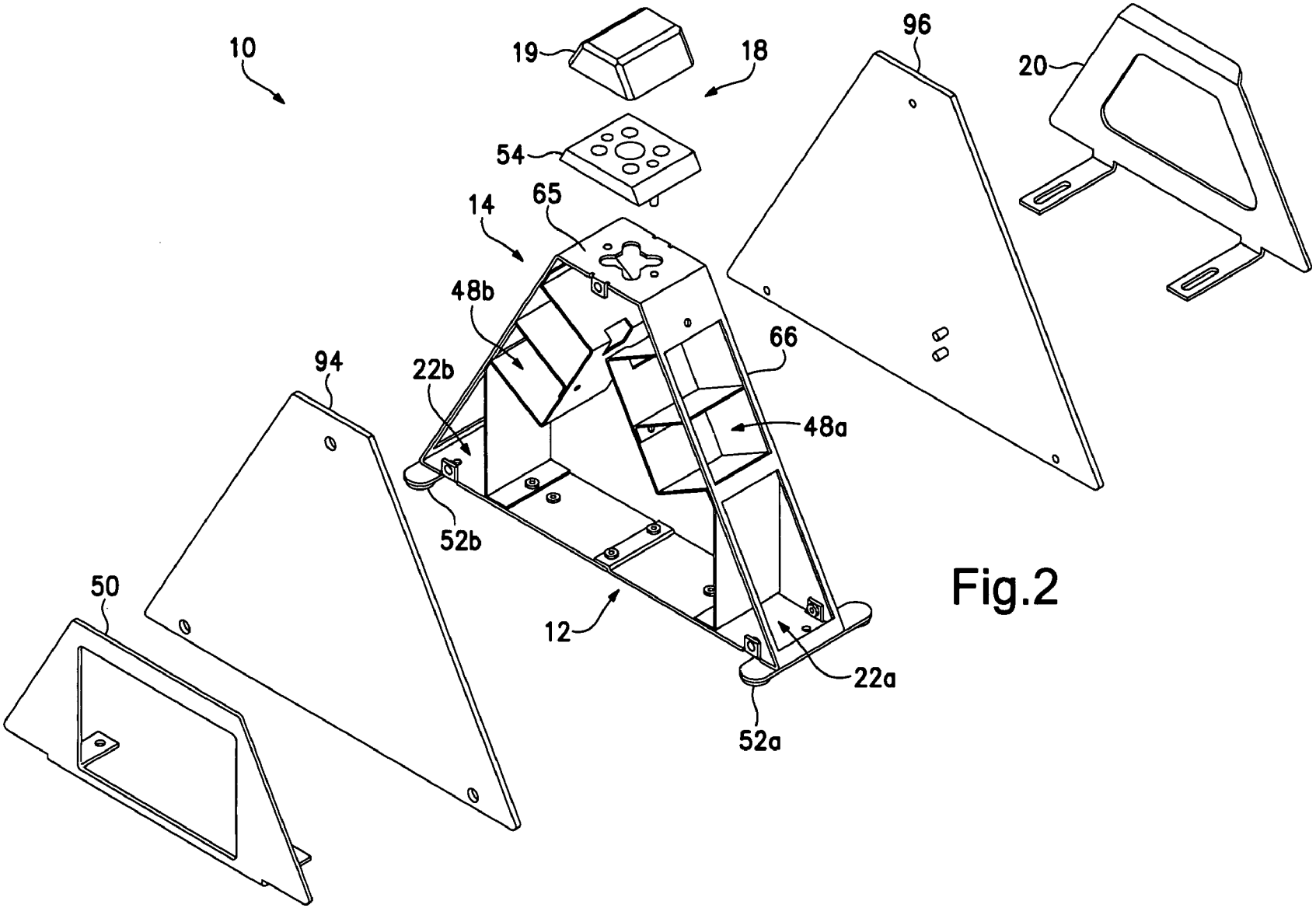
FIG. 2 is an isometric view corresponding with FIG. 1 but illustrating the annunciator/pager in exploded form to show details of its construction.

FIG. 1 is an isometric assembly view of invented annunciator/pager 10. FIG. 2 is an isometric exploded view corresponding with FIG. 1.

Referring collectively to FIGS. 1 and 2, annunciator/pager 10 includes a base 12 configured to recline on a retail tabletop and preferably having a small footprint; a tapered body 14 extending upwardly from the base; and a combination light/switch 16 adjacent an apex of tapered body 14, the switch/light configured alternately to switch a visible light on and off when the switch is manually actuated. Tapered body 14 is configured to provide within its outer periphery one or more (and preferably two or more) open compartments configured to store condiments or the like. Combination light/switch 16 is integrally housed in what will be referred to herein as a cover 18 that includes a translucent or transparent lens 19 engraved with one or more company identity indicia (e.g. at least one indicium including one or more of the retailer name, address, phone number and logo) that is preferably interior to or embedded in lens 19 and that is illuminated by the visible light, but that can, within the spirit and scope of the invention, be surface-exterior to or embossed on an exterior surface of lens 19.

In accordance with one embodiment of the invention, base 12 includes a laterally extendable holder 20 for paper products or the like, e.g. napkins or menus (not shown). Also in accordance with one embodiment of the invention, base 12 provides one or more support regions 22*a*, 22*b* for one or more of a salt and a pepper shaker (not shown). Those of skill in the art will appreciate that the salt and pepper shakers can be stock items belonging to the restaurant or bar, or they can be custom designed to compliment annunciator/pager 10.

Referring still to FIGS. 1 and 2, the visible light of combination light/switch 16 is configured to be intensity adjustable. This is accomplished by employing one or more low-power, high-intensity LEDs in the light source, wherein the intensity of the light is adjusted by populating more or fewer of four LED sockets provided as part of an electrical circuit indicated generally at 24 in FIG. 1. In order to increase the apparent intensity of the visible light, the geometric design of cover 18 renders combination light/switch 16 rectangular in top view and trapezoidal in a side elevation. The upper rectangular edge of the rectangular/trapezoidal switch/light is faceted or beveled to act as a lens that increases the visibility of the visible light. Thus, the upper translucent or transparent portion of cover 18 is referred to herein broadly as lens 19.

Referring particularly now to FIG. 1, the visible light or light source of annunciator/pager 10 includes one or more low-power light-emitting devices, e.g. light-emitting diodes (LEDs) such as LEDs 26, 28, 30, 32 held securely within corresponding sockets 34, 36, 38, 40 (the last pair of which is omitted for clarity from FIG. 2) mounted in accordance with one embodiment of the invention beneath lens 19. The switch that is integral with light/switch 16 will be understood by those of skill in the art to be bi-stable, i.e. it is configured alternately to close and open when successively depressed. Thus, the visible light operatively coupled with the bi-stable switch alternately goes on and off when the switch is actuated. In this way, a customer can cause the visible light to go on by operating the switch once and a responsive server can cause the visible light to go off by operating the switch again. Such is possible by the slightest depression of a micro-switch mounted beneath and operatively coupled with lens/cover 18.

In accordance with one embodiment of the invention, electrical circuit 24 contained within tapered body 14 and preferably mounted on a printed circuit board (PCB) 42 thus selectively powers one or more low-power LEDs 26, 28, 30, 32 in response to actuation of the bi-stable switch. Those of skill will appreciate from the detailed description below by reference to FIG. 3 that circuit 24 includes one or more and preferably four series-connected batteries capable of powering the one or more low-power LEDs 26, 28, 30, 32 selectively connected to the one or more batteries via the bi-stable switch. Those of skill in the art will appreciate that circuit 24 optionally further includes a transmitter for transmitting to a remote wireless receiver a signal indicating an on-off status of the one or more low-power light-emitting devices such as LEDs 26, 28, 30, 32. By the use of this wireless transmitter, the on-off status of the light-emitting devices can be remotely monitored and/or timed manually or automatically, as will also be described in detail below by reference to FIG. 3.

Figure 4:
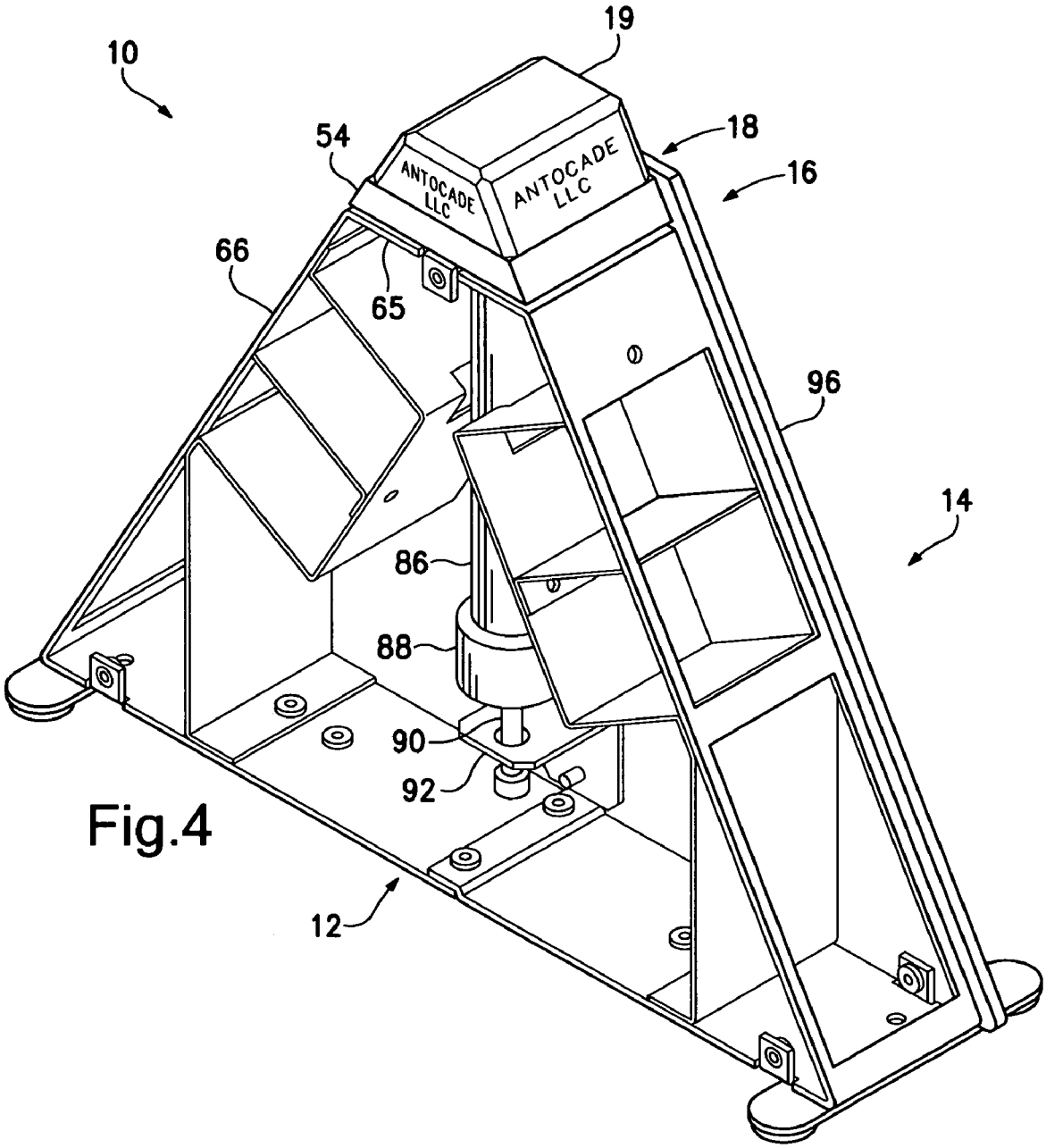
FIG. 4 is an isometric view of the invented annunciator/pager in mostly assembled form, like that of FIG. 1, but in accordance with another embodiment of the invention in which the electronics and light/switch combination is realized in the form of a stock miniature pushbutton flashlight.

Invented tabletop centerpiece 10 thus can be understood to include a generally rectangular base 12 having a footprint small enough readily to fit on a tabletop; a body 14 including tapered sides that incline upwardly and inwardly from the base from at least one lateral viewing perspective in a generally triangular configuration; a visible light that preferably a part of integral light/switch 16 mounted near the top of body 12, wherein the visible light includes one or more light-emitting devices, e.g. one or more LEDs 26, 28, 30, 32 or one or more incandescent bulbs; a translucent or preferably transparent lens 19 over the light, the lens being beveled to act as a lens to disperse the visible light; circuitry 24 configured selectively to couple power to the visible light; and a switch that preferably also preferably a part of integral light/switch 16 preferably coupled with the circuitry to toggle the visible light on and off, wherein lens/cover 18 preferably includes embedded therein a company identity indicium, as shown in FIG. 4. Preferably, the switch is substantially integrally housed with the visible light within the lens/cover.

Base 12 preferably includes laterally extendable holder 20 for paper products, e.g. napkins or menus, or the like, as described above. Base 12 preferably also provides one or more support regions 22*a*, 22*b* for one or more (and preferably for both) of a salt and a pepper shaker. Moroever, at least one (and preferably both) of the tapered sides of body 14 provides within its outer periphery one or more open compartments 48*a*, 48*b* configured to store and dispense condiments, e.g. packets of sugar and/or creamer. Compartments 48, 48*b* can be seen from FIG. 1 to be dimensioned tightly and neatly to contain a stacked plurality of condiment packages and to slant inwardly and downwardly toward base 12 at generally right angles to the tapered sides of body 14, thus to dress and better contain the condiment stack. In accordance with this embodiment of the invention, the extendable holder takes up little or no extra table space (an extra amount of space that is slidably, adjustably small), the salt and pepper shaker support regions take up no extra table space whether empty or full and the condiment compartments even when full take up no extra table space. All such useful additions to centerpiece 10 are space-saving because the bulk of the space they consume, even when full, is within the perimeter of base 12 and within the periphery of body 14.

Preferably, circuitry 24 further includes transmitter, as will be seen by reference to FIG. 3 described below, for transmitting to a remote wireless receiver a signal indicating an on-off status of the visible light. Thus centerpiece 10 can be thought of as a tabletop centerpiece providing a so-called "annunciation" function by its use of a visible light to call for customer service from an attentive but busy server. Moreover, centerpiece 10 optionally provides a paging function by transmitting the status of the visible light to a remote receiver that may be located in the restaurant's or bar's kitchen, office or other more central oversight location.

As noted above, selected color-characteristic LEDs 26, 28, 30 and 32 selectively populate sockets 34, 36, 38, 40, (only the first three pairs of which are shown in FIG. 1 for clarity) thus providing in accordance with a preferred embodiment of the invention a visible light that is configured to be color and intensity adjustable. In other words, by populating 1-4 sockets with 1-4 corresponding light-emitting devices of given light-emitting wavelengths, the user obtains the added benefit of being able to choose the color and intensity of the visible light emanating from centerpiece 10. Thus, a particular mood or feel of a restaurant, bar or coffee shop need not be compromised by garish or dissonant tabletop centerpiece lighting.

As will be seen from the description below of FIG. 3, circuitry 24 is configured further automatically to decouple power from the visible light, regardless of the on-off status of the switch, after a predetermined period of time, thereby to preserve power. Thus, batteries having limited life and utility can nevertheless have their lives substantially extended by this power-save feature. This optional feature is intended to guard against a customer, server or the like inadvertently (unintentionally) leaving the light on after hours and running down the batteries. The shut-off time can be made to be programmable, e.g. by inclusion of a potentiometer or dipswitch, and typically might be set at approximately fifteen minutes. Thus, the life of the batteries is extended and the utility of the tabletop centerpiece is improved.

Body 12 in accordance with one embodiment of the invention further includes a framed surface pocket 50 configured securely to hold advertising or menu copy inserted therein. Pocket 50 can be seen from FIG. 2 to be relatively small in dimension and preferably rectangular, thereby to support advertising copy such as a business card or calendar of events or open hours for the restaurant, bar or coffee shop, or to support a menu du jour for highly visible presentation to a customer. Pocket 50 preferably is provided as a flat surface pocket located on a front or rear panel (or both) of centerpiece 10. Advertising or menu copy can easily be inserted into pocket 50 by sliding it through an opening therein to squarely align and 'frame' the advertising or menu copy as shown for an aesthetically pleasing look and feel.

Finally, base 12 of centerpiece 10 can be seen from FIGS. 1 and 2 to be equipped with standoffs 52*a*, 52*b* to stabilize and elevate the base, and thus the entire centerpiece, slightly above the surface of the tabletop. Moreover, it will be appreciated that base 12, body 14 and cover 18 are configured and joined together collectively to form an enclosure that is substantially impervious to moisture from spilling or wiping. Those of skill in the art will appreciate that standoffs 52*a*, 52*b* elevate the base, body and lens/cover above the tabletop thus to avoid spills from invading the body of centerpiece 10, while the material and assembly configuration of the base, body and lens/cover promote a tight sealing of the piece parts in assembly thus to create a integral, substantially closed volume that houses and keeps dry the electronic circuitry and paper contents of centerpiece 10.

In the interest of completeness of disclosure, and not intended in any way as a limitation on the scope of the invention, certain structural, material and dimensional details will now be further described.

The small footprint of annunciator/pager 10 renders the invention very useful in that it is unimposing where space is constrained on a tabletop. In accordance with one embodiment of the invention, base 12 describes a rectangle approximately 2.125" deep and 11.0" wide, as noted above, to provide a relatively small footprint for tabletop placement. Also in accordance with one embodiment of the invention, annunciator/pager 10 is approximately 8.0" high. Moreover, its lightweight construction, preferably of limited cold-rolled steel and generous die-stamped and folded aluminum, with an acrylic or glass lens/cover and stainless steel fasteners, renders annunciator/pager 10 very portable and easily stowed, transported or employed on a tabletop. Easily replaceable batteries provide reliable, long periods of operation and easy changing, thereby rendering annunciator/pager 10 entirely self-contained without the need for an external battery charger or AC adaptor.

By holding tight tolerances and using machined parts, annunciator/pager 10 is moisture resistant, which often is important in a restaurant or bar context where food and beverages are consumed and sometimes spilled. Stainless steel fasteners, e.g. screws, nuts and bolts, are used for durability, and in accordance with one embodiment, the heads of the screws and nuts are rendered substantially tamper-proof by the use of star-patterned, Allen-patterned (hexagonal) or TORX™-headed designs. Annunciator/pager 10 is equipped with moisture-resistant, non-scratch plastic stand-offs of stand-off feet 52*a*, 52*b* so that tabletops are not scratched and so that moisture from spills does not wick up into the housing. In accordance with one embodiment of the invention, the housing is of a durable two-tone powder-coated finish, which is available in various colors, and operating instructions are silk-screened thereon for ease of installation, use and maintenance.

Those of skill in the art will appreciate from FIG. 2 that a lens base 54 that forms a lower portion of cover 18 beneath lens 19 is provided of machined aluminum and is configured universally to accommodate a plural LED light source socket and micro-switch configuration or the push-button flashlight light source configuration, thus encouraging flexibility. Those of skill in the art also will appreciate that lens 19 can be made of crystal (e.g. K-9 optical grade glass) or acrylic that preferably is transparent. Either of these materials, or any other suitable material, for the lens/cover can be molded or machined with faceted edges, as described and illustrated herein, and either can be engraved (within its interior region, in the case of the crystal; upon its external surface, in the case of the acrylic) with one or more company identity indicia such as name, address, phone number and logo. Such engraving preferably is performed by a three-dimensional (3D) laser etching process available, for example, from Shanghai MeiHao (access via www.mhjs.com). In accordance with one embodiment of the invention, lens/cover 18 is approximately 1.9" deep, 2.0" wide and 0.75" high, and each of its eight edges is faceted (beveled) to act as a lens to better transmit and disperse light from the light source, although those of skill in the art will appreciate that, within the spirit and scope of the invention, alternative shapes, dimensions, materials and facet designs can be featured.

Detailed 3D company logos or other abstract or realistic images are possible with such a laser engraving process and greatly improve the aesthetic design of the invented annunciator/pager. The engraved image becomes highly visible when illuminated, providing a high-profile self-promotional opportunity for the restaurant or bar. Alternatively, of course, the company identity indicia can identify an owner, investor, sponsor, supplier, patron or other associate of the restaurant or bar, thereby providing a high-profile third-party (3P) or affiliate promotional opportunity.

Illustrated in FIG. 4 only, for the sake of clarity, is company identity indicia "ANTOCADE LLC" that appears within each of the four faces of lens/cover 18 (only two are shown). ANTOCADE LLC of Tigard, Oreg., USA, the assignee of the invention disclosed and claimed herein. Those of skill in the art will appreciate that any text, graphic or 3D sculpture can be formed within the interior of lens/cover 18, within the spirit and scope of the invention. Thus the illustration is in no way limiting of the myriad possibilities for professionally and aesthetically branding and advertising the invented tabletop centerpiece.

Those skilled in the art will appreciate that the lens/cover alternatively but within the spirit and scope of the invention can be tinted or colored so that it is somewhat translucent, while leaving the company identity indicia readily visible and while providing sufficient intensity to annunciate to a server the need for customer service.

The LEDs of the preferred embodiment can be color selected to compliment the mood for a particular restaurant or bar. Those of skill in the art will appreciate that red, blue and amber LEDs are widely available and that other colors can also be used. Thus, the intensity of the light source for annunciator/pager 10 can be adjusted by selecting a desired number of LEDs to populate the PCB sockets while the color of the light source for annunciator/pager 10 can be adjusted by selecting a desired color of LEDs.

FIG. 2 best shows optional extendable paper products, e.g. napkin/menu, holder 20 as well as an optional 3"×5" advertising/daily special notice display holder or surface pocket 50, respectively situated on a first and second face of annunciator/pager 10. Napkin/menu holder 20 preferably is mounted using screws extending through slotted holes so that it is easily slidably adjustable to accommodate varying thicknesses and numbers of napkins and/or menus without resort to a separate napkin or menu holder that takes up more tabletop space. It is adjustable by adjusting its mounting hardware to permit a slightly frictional but slidable fit beneath base 12 of the annunciator/pager. Advertising/daily special notice display holder 50 preferably includes a panel with a rectangular "window" cutout therein, as shown, behind which daily special or other advertising copy can be placed and the holder secured with hardware, as shown.

In accordance with one embodiment of the invention, quick and easy access is provided to the batteries mounted on base 12 of annunciator/pager 10, as shown in FIG. 1. A battery holder 58 is adhered via adhesive to a battery access door 60 that preferably is hinged on one end (thus to pivot temporarily in the direction of the curved arrow of FIG. 1) and more often is secured in place via a screw or bolt on the other, as shown. Battery holder 58 is configured to accommodate up to approximately four AAA batteries or a 9V battery, as needed, and includes any needed springs for tension to secure the batteries in place and in proper electrical connection with each other. It provides a first wiring harness 62 to deliver DC power, as shown, to PCB 42 preferably via mating quick connector components. A second wiring harness 64 is provided to convey the open/closed position of the switch to PCB 42 and to convey selective DC power to bias the LEDs on, also preferably via mating quick connector components. The micro-switch is mounted to the lower surface of a top flat expanse 65 of a preferably metal (e.g. 16 gauge steel) frame 66, as shown in FIG. 2. The lens base is spring-mounted to the top expanse via two slightly oversized counter-bores 68*a*, 68*b* into which are fit a pair of 6-32 studs and a pair of low-tension (pressure-gauged to produce a desired level of resistance and to provide adequate tactile feedback) coil springs extending helically therearound. A pair of 6-32 nuts secures the lens/cover base to the frame.

Figure 3:
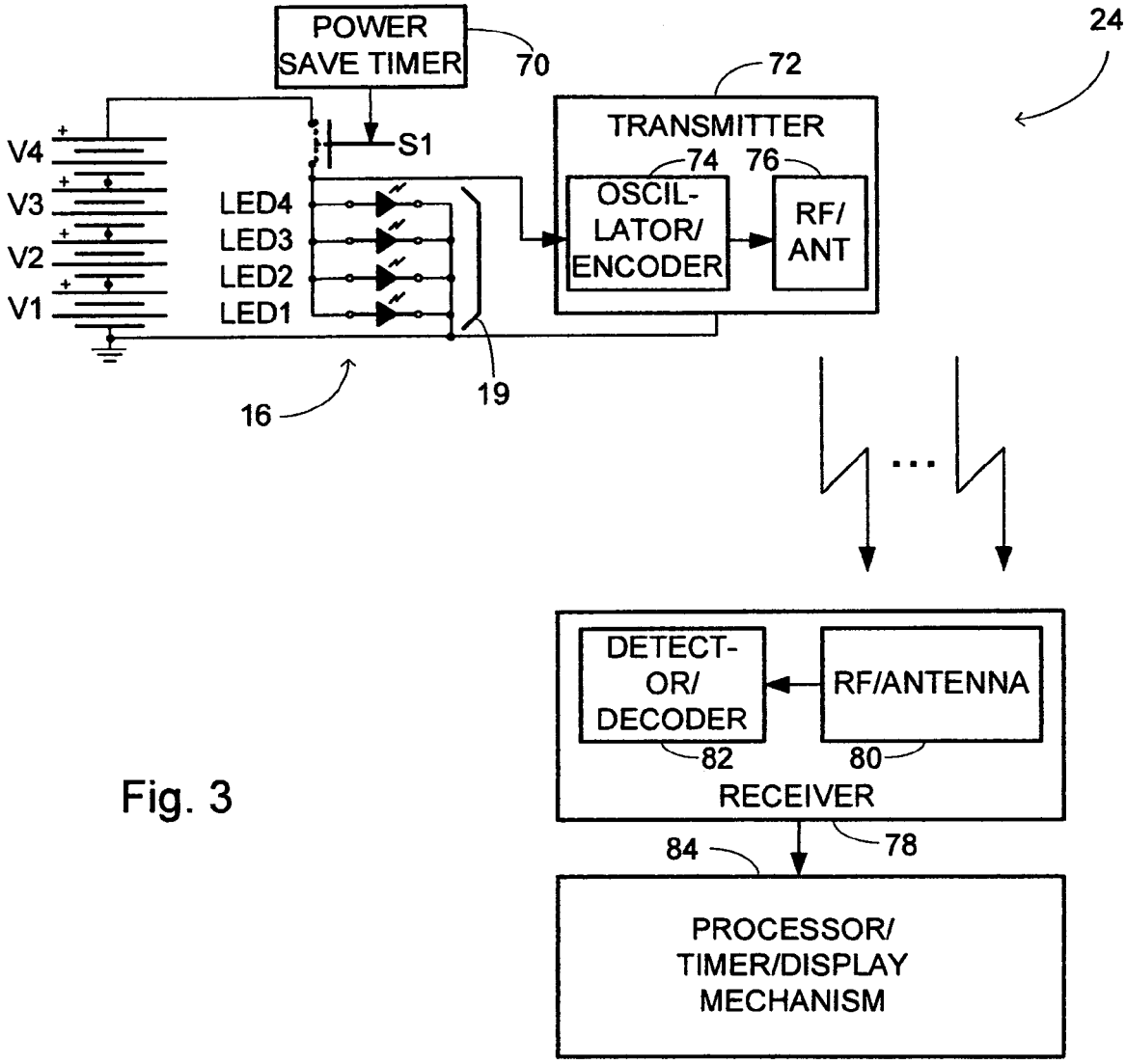
FIG. 3 is a schematic block diagram of the switch/light circuit that selectively illuminates the annunciator/pager of FIG. 1. The block diagram illustrates an optional local transmitter and remote receiver responsive thereto for remote monitoring of the on/off status of the annunciator/pager.

FIG. 3 schematically illustrates circuitry 24 that preferably is mounted on PCB 42 mounted on a stand-off as shown in FIG. 1 within metal frame 66 of invented tabletop centerpiece annunciator pager 10. Circuitry 24 may be seen to include one or more batteries such as series-connected batteries V1, V2, V3, V4 that operatively selectively supply power to visible lights LED1, LED2, LED3, LED4, depending upon the on-off state of switch S1. Those of skill in the art will appreciate that the four illustrated batteries V1, V2, V3, V4 are shown connected in series, but that, within the spirit and scope of the invention, they may number more or fewer and may be connected alternatively with one another and with switch S1 and the light source.

Those of skill also will appreciate that the four illustrated LED1, LED2, LED3, LED4 can also number more or fewer in accordance with the invention. Preferably, LED1, LED2, LED3, LED4 are selectively placed in sockets, as is shown in FIG. 2 described above, so that they can easily be added and removed to change the color or to increase or decrease the intensity of the light source. Also within the spirit and scope of the invention, the LEDs can be replaced by low-power DC-operated incandescent bulbs having, for example, color-filtering lenses that produce a desired color and intensity of light to switch/light 16. Indeed, any suitably high-intensity, visible light source can be used within the spirit and scope of the invention.

Finally, those of skill in the art will appreciate that in accordance with one embodiment of the invention, switch S1 is a bi-stable (two-position) pushbutton switch that can be toggled by successive depressions into two different states: one open wherein no power is supplied to the LEDs and the other closed whereby power is supplied in parallel to any and all LEDs that populate the LED sockets. Those of skill in the art will appreciate that switch S1 is described and illustrated broadly herein to refer to the switching function performed by the switch selectively to supply DC power to the light source. Thus, it will understood that switch S1 can physically take the form of a single-pole, single-throw (SPST) switch the opening and closing functions of which are rendered bounce-free and stable by use of resistors, capacitors and a cross-coupled NAND latch (or set-reset (SR) flip-flop or other suitable bistable digital device) to store and toggle the present on-off state of the light source. Alternatively, switch S1 can physically take the form of a simple pushbutton switch that features bi-stability, i.e. a stable on mode and a stable off. mode occasioned by alternating depressions of the pushbutton. Thus the invention is not limited in any way to any particular physical form of the on-off switching/lighting function performed by combination switch/light 16.

In accordance with one embodiment of the invention, the visible light source including one or more of LED1, LED2, LED3, LED4 and switch S1 are integrally housed within cover 18 (including lens 19 and lens base 54) mounted with a gap G (of preferably only approximately 0.032") on top flat expanse 65 of metal frame 66, all best shown in FIGS. 1 and 2 and discussed above. Alternatively, yet within the spirit and scope of the invention, the visible light and the switch that selectively actuates the visible light can be separated by a desired distance and can be located anywhere in or on the housing. But it is believed to be extremely convenient and intuitive to switch the visible light on and off by simply and very lightly depressing the lens/cover in which the visible light and the switch are housed, thereby providing positive tactile and visual feedback and thus tightly coupling cause and effect in the mind of the user. Those of skill in the art will appreciate that the LEDs can be driven via a conventional switching transistor that ensures no leakage when switch S1 is off. Variable intensity control can be provided if desired to the LEDs via use of a potentiometer, as is known. Finally, those of skill also will appreciate that power can be applied to the battery save and other circuitry only when switch S1 is on, thereby further extending the life of the batteries and providing months of standby time.

Those of skill in the art will appreciate that a lens 19 preferably is provided that disperses and thus effectively amplifies the visible impact of the light source. This optical element is shown schematically in FIG. 3 for completeness, but is better illustrated in FIGS. 1, 2 and 4. It will be appreciated that lens 19 preferably takes the form of one or more and preferably plural facets formed in the crystal apex light lens/cover/light switch at the apex of invented annunciator/pager 10. Those skilled in the art will appreciate, however, that alternative lens or light-dispersal/amplification configurations and techniques are contemplated and are within the spirit and scope of the invention.

Two optional features of invented annunciator/pager 10 are also illustrated in FIG. 3. First, a power-save timer circuit 70 can be incorporated to control switch S1 or otherwise suitably to interrupt power to the light source, as is schematically illustrated, after a determined period of on-time, e.g. approximately 15 minutes (hopefully, a customer would never wait more than fifteen minutes to be served!). Such a power-save timer circuit can be straightforwardly implemented, for example, by use of an integrated circuit (IC) 555 timer chip the timing of which is a function of a resistor-capacitor (RC) time constant. Second, circuitry 24 can optionally include a transmitter 72 that, in turn, includes an oscillator/encoder 74 and a radio frequency (RF) driver circuit and antenna (RF/ANTENNA) 76. Those of skill in the art will appreciate that transmitter 72 responsive to the on-off state of switch S1 selectively oscillates and transmits wirelessly a signal of a given frequency and power detectable at a predetermined distance from annunciator/pager 10 of modulates an RF carrier with a digital signal containing a unique identification code or identifier for each individual transmitter.

Those of skill in the art will appreciate that such wireless transmitter circuitry can be conventional, as used in remote signaling applications such as remote control airplanes or household appliances, e.g. DVDs, stereos and TVs and garage door openers, and typically involves the use of high-precision crystal oscillators at least partly in integrated circuit form and straightforward analog signal conditioning and sampling or periodic-waveform detection circuitry such as well-known phase-locked loops (PLLs). The effective range of the transmitter, e.g. 100 feet, more or less, preferably is designed to be commensurate with the distance between the furthest table on which the annunciator/pager 10 may be placed and the receiver to be described below, which may be placed in the drinking or dining facility's kitchen, manager's office or alternative (typically central) location typically somewhat remote from plural instances of annunciator/pager 10.

Those of skill in the art will appreciate that alternative wireless conveyances are contemplated. For example, infrared (IR) power can be used instead of RF power, although RF generally is more robust and goes through walls whereas IR generally is restricted to line of 'sight.' Those of skill in the art also will appreciate that the use of RF may impose certain regulatory compliance requirements, e.g. licensing, depending upon the jurisdiction in which the invention is used. Thus, any suitable wireless conveyance is contemplated as being within the spirit and scope of the invention.

Those of skill in the art will also appreciate that circuit 24 can take any suitable form. For example, the digital circuitry can be integrated into one or more custom IC packages and mounted suitably on a PCB of any size or configuration, as suggested by FIG. 1, along with a few external discrete components. Those of skill also will appreciate that the light/switch, power-save timer circuitry and transmitter circuitry can be implemented as a synchronous state controller that synchronizes the asynchronous switch closure input with an internal system clock to avoid so-called "race" conditions. Those of skill also will appreciate that such a state controller can be implemented in a microcontroller executing state control instructions stored in a read-only memory (ROM). All such suitable alternatives are contemplated, and are within the spirit and scope of the invention.

A receiver 78 optionally is provided that is responsive to one or more such instances of transmitter 72. Receiver 78 can take the form of a multi-frequency radio frequency receiver/antenna (RF/ANTENNA) circuit 80 that is perpetually "listening" for transmitters such as transmitter 72 transmitting nominally at plural predefined frequencies and a detector/decoder 82 that detects when and at which nominal frequency the one or more of such transmitters is determined to be transmitting. Alternatively, receiver 78 can take the form of a single-frequency radio frequency receiver/antenna (RF/ANTENNA) circuit 80 that is perpetually "listening" for transmitters such as transmitter 72 transmitting nominally at a single predefined frequency and a detector/decoder 82 that decodes an embedded identification code that corresponds with a given one of such transmitters. (In the latter case, those of skill will appreciate, a queue can be provided to ensure that communications arriving simultaneously from two or more transmitters are all received and properly decoded. Such might further require multiple transmissions in the case of one such communication being lost. Such might further require a simple ACK/NACK (acknowledged/not acknowledged) communication protocol between each transmitter and the common receiver to ensure communication integrity. Those of skill will appreciate that any suitable asynchronous (start-stop) or other communication protocol and coding regime can be used within the spirit and scope of the invention. Furthermore, any suitable communication and time-slicing or multiplexing techniques can be used, within the spirit and scope of the invention to avoid collisions and/or loss of data or command and control).

Thus, receiver 78 properly and perpetually ascertains the on or off state of the light at each of the plural instances of annunciator/pager 10 in a given retail establishment such as a restaurant, bar or coffee shop.

Detector/decoder 82 can be conventional, and need simply detect threshold analog signal energy bursts at plural defined frequencies corresponding to those assigned frequencies of the plural instances of transmitter 72 or decode a unique identification code or identifier embedded in a digital signal that modulates an analog carrier signal corresponding to those assigned identifiers of the plural transmitters. For example, receiver 78 can operate similarly to the way a universal receiver in a home-entertainment system might work in response to various operatively coupled remote control units (RCs). Alternative detection/decoding schemes are contemplated as being within the spirit and scope of the invention.

Receiver 78 preferably is operatively connected to a processor/timer/display mechanism 84 that is capable at least of timing and logging the on-time for each defined transmitter and optionally of displaying a map or other indicator of the location of the annunciator/pager that is on. Time-of-day stamping can be used along with an on of off indication and a unique identification code—with each transmitter transmitting a short burst of one or two bytes of data upon a change of the on-off condition of the light/switch—and the processor/timer can calculate the on-time for each light/switch. Alternatively, each transmitter can continuously transmit its unique identification code for as long as its light/switch is on, and the processor/timer can simply deduce the duration of time by use of a counter or real-time clock. Either way, the elapsed time may be interpreted to represent the cumulative amount of time the customer has awaited service.

Those of skill will appreciate that receiver 78 thus may be monitored either automatically by processor/timer/display mechanism 84 or manually by other staff persons including a manager of the restaurant or bar to ensure a high level of customer service delivery. Clearly, the more time a given annunciator/pager 10 is on, the longer a customer is waiting for service. Thus, employee performance in terms of responsiveness may be monitored by management and employee rewards (e.g. for servers whose assigned tables had their annunciators/pagers off most of the time) or remedial training (e.g. for servers whose assigned tables had their annunciators/pagers on much of the time) can be given. Thus, invented annunciator/pager 10 may be used as an employee training tool or a customer service metric or an extraordinary service reward system, or a combination of these, depending upon a particular establishment's management style.

Thus, the invented tabletop annunciator/pager system can be understood to include an annunciator (e.g. the visible light that is selectively switchable on and off via a switch within preferably integral light/switch 16); a wireless pager (e.g. transmitter 72) for wirelessly communicating from the tabletop annunciator to a remote receiver the on-off status of the visible light; and an integral housing for the annunciator and for the wireless pager, the housing being configured and sized for placement on a tabletop. Thus, "housing" as it is used herein refers alternatively to base 12, body 14 and lens/cover 18, or to metal frame 66 closed by the two front and rear face plates.

Those of skill in the art will appreciate that, in a typical setting and intended use of the invention, plural instances of tabletop annunciator/pager 10 will be provided. In any case, the invented system further includes a wireless receiver 78 remote from and responsive to the plural instances of the wireless transmitter. As described above, such a receiver is configured to distinguish among the plural transmitters thereby to determine which one or more lights is on and for how long. Thus, in accordance with one embodiment of the invention, the system further includes a processor (e.g. that shown in block 84) operatively coupled with wireless receiver 78, the processor configured to determine the lengths of time the lights of the plural instances of the tabletop annunciator/pager are in an on state. Finally, the system preferably further includes a mechanism (e.g. that shown also in block 84)

coupled with the processor to display or record a representation of the determined lengths of time.

Those of skill in the art will appreciate that such a display or record of a representation of the determined lengths of time a given one or more lights has been on broadly refers to any suitable representation. For example, a small display board with a floor plan of the restaurant, bar or coffee shop's layout and the location of its tables could be provided. Each table could have a light indicating whether the tabletop annunciator is on or off. Such would provide a visual representation. Alternatively, a digital representation in the form of a graph or table showing the instantaneous or average on-time of the lights of the various tables could be presented on a laptop or desktop computer. Alternatively, such could be printed and presented in the form of a processed-data report, whether graphically or numerically or otherwise. Any such time-data representations could be recorded in a memory device, or sent to a remote host server for archival storage, further processing and/or further reporting.

Thus, all such suitable determined lengths of time on, time off or general light status data representations however raw or finely processed and however presented or recorded are contemplated as being within the spirit and scope of the invention.

FIG. 4 is a partially cutaway isometric view of the invention similar to FIG. 1 but showing an alternative embodiment of the invention in which the battery, switch and light source take the form of a stock pen flashlight 86 of suitable configuration and size and preferably featuring a proximal-end positioned push-button on-off switch, e.g. a MagLite™ flashlight. It may be seen from FIG. 4 that the PCB is omitted in this embodiment of the invention and that switch/light 16 in this embodiment takes the form of a compact, self-contained flashlight having a pushbutton switch at its proximal end or base and a light source at its distal end or apex. The flashlight is captured within metal frame 66 of annunciator/pager 10 by extending its cylindrical distal end through the hole in the top flat expanse 65 of metal frame 66 and its proximal, pushbutton, end partway into a cylindrical collar 88. When lens/cover 18 is depressed slightly, the body of the flashlight is urged downwardly to actuate the pushbutton switch against a confronting post 90 (mounted preferably for height adjustment on an elevator bracket 92, as shown) that is mounted in turn to a front or rear face plate 94 or 96. Flashlight 86 can be easily replaced or its batteries recharged or replaced by simply removing the front or rear face plate. Those of skill in the art will appreciate that light from the flashlight's light source (typically an incandescent bulb) emanates from the faceted edges of lens/cover 18. Alternative light/switch combinations are contemplated as being within the spirit and scope of the invention.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

From the foregoing, those of skill in the art will appreciate that numerous advantages of the present invention include the following.

The present invention provides:

1) Faster service for the customer;
2) Increased sales for the business;
3) Increased repeat business;
4) Vastly improved customer. satisfaction;
5) Easier job for the servers;
6) Increased tips for the servers;
7) Fewer unnecessary interruptions;
8) Optical communication between the customer, the server and management;
9) Aesthetically pleasing functional design;
10) Faster table turnover during peak business hours;
11) Food and beverage advertisement;
12) Name of business advertisement;
13) Professional appearance for restaurant or bar;
14) Neat and consistent salt, pepper, sugar, napkins and menu organization; and
15) Fewer customer complaints;
16) Faster response by staff to fewer customer complaints;
17) Inexpensive and easy installation and maintenance;
18) Compact footprint on table for all customer needs;
19) Ease of use by conveniently summit-located customer-on, server-off one pushbutton switch/light design and by screen printed instructions;
20) Good illumination and visibility, adjustable for decor and lighting;
21) Low power consumption and quick-change battery pack and power save;
22) Self-contained, lightweight portability;
23) Moisture-resistant housing; and
24) Durable, easily cleaned, tamper-proof construction.

These and other advantages of the invention are achieved in accordance with the embodiments described and illustrated herein.

It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

I claim:

1. A retail customer service annunciator/pager comprising:

a base configured to recline on a retail tabletop;

a tapered body extending upwardly from the base; and a combination switch/light adjacent the apex of the tapered body, the switch/light configured alternately to switch a visible light on and off when the switch is manually actuated, wherein the tapered body is configured to provide within its outer periphery one or more open compartments configured to store condiments.

2. The annunciator/pager of claim 1, wherein the base includes a laterally extendable holder for paper products or the like.

3. The annunciator/pager of claim 1, wherein the base provides a support region for one or more of a salt and a pepper shaker.

4. The annunciator/pager of claim 1, wherein the visible light is configured to be intensity adjustable.

5. The annunciator/pager of claim 1, wherein the combination switch/light is rectangular in top view and trapezoidal in side elevational view, and wherein the upper rectangular edge of the rectangular/trapezoidal combination switch/light is faceted to act as a lens that increases the visibility of the visible light.

6. The annunciator/pager of claim 1, wherein an upper region of the combination switch/light is translucent or transparent and includes embedded therein a company identity indicium.

7. The annunciator/pager of claim 6, wherein the retailer identity indicium is illuminated by the visible light, and wherein the retailer identity indicium includes one or more of the company name, address, phone number and logo.

8. The annunciator/pager of claim 1, wherein the tapered body provides within its outer periphery two or more open compartments configured to store condiments.

9. The annunciator/pager of claim 1, wherein the light source includes one or more low-power light-emitting devices and wherein the switch is bi-stable, which further comprises:

an electrical circuit contained within the tapered body for selectively powering the one or more low-power light-emitting devices in response to actuation of the bi-stable switch, the circuit including one or more batteries capable of powering the one or more low-power light-emitting devices selectively connected to the one or more batteries via the bi-stable switch.

10. The annunciator/pager of claim 9, wherein the electrical circuit further includes a transmitter for transmitting to a remote wireless receiver a signal indicating an an-off status of the one or more low-power light-emitting devices.

11. A retail customer service annunciator/pager comprising:

a base configured to recline on a retail tabletop;

a tapered body extending upwardly from the base; and a combination switch/light adjacent the apex of the tapered body, the switch/light configured alternately to switch a visible light on and off when the switch is manually actuated, wherein the combination switch/light includes a translucent or transparent cover that is engraved with a company identity indicium.

12. The annunciator/pager of claim 11, wherein the company identity indicium is interior to the cover.

13. The annunciator/pager of claim 12, wherein the company identity indicium is illuminated by the visible light and wherein the retailer identity indicium includes one or more of the retailer name, address, phone number and logo.

14. The annunciator/pager of claim 11, wherein the base includes a laterally extendable holder for paper products or the like.

15. The annunciator/pager of claim 11, wherein the base provides a support region for one or more of a salt and a pepper shaker.

16. The annunciator/pager of claim 11, wherein the visible light is configured to be intensity adjustable.

17. The annunciator/pager of claim 11, wherein the cover is rectangular in top view and trapezoidal in side elevational view, and wherein the upper rectangular edge of the cover is beveled to act as a lens that increases the visibility of the visible light.

18. A tabletop centerpiece comprising:

a generally rectangular base having a footprint small enough readily to fit on a tabletop;

a body including tapered sides that incline upwardly and inwardly from the base from at least one lateral viewing perspective in a generally triangular configuration;

a visible light mounted near the top of the body, wherein the visible light includes one or more light-emitting devices;

a translucent or transparent cover over the light upper outer edges of the cover being beveled to act as a lens to disperse the visible light;

circuitry configured selectively to couple power to the visible light; and a switch operatively coupled with the circuitry manually selectively to toggle the visible light on and off, wherein the cover includes embedded therein a company identity indicium.

19. The centerpiece of claim 18, wherein the switch is integrally housed with the visible light within the cover.

20. The centerpiece of claim 19, wherein the base includes a laterally extendable holder for paper products or the like, wherein the base provides a support region for one or more of a salt and a pepper shaker, and wherein at least one of the tapered sides of the body provides within its outer periphery one or more open compartments configured to store and dispense condiments, the one or more compartments slanting inwardly and downwardly toward the base at generally right angles to the tapered sides of the body.

21. The centerpiece of claim 20, wherein the company identity indicium is illuminated by the visible light, wherein the company identity indicium includes one or more of the company name, address, phone number and logo, and wherein the company identity indicium is engraved within an interior of the cover.

22. The centerpiece of claim 21, wherein the circuitry further includes a transmitter for transmitting to a remote wireless receiver a signal indicating an on-off status of the visible light.

23. The centerpiece of claim 22, wherein the visible light is configured to be color and intensity adjustable by populating sockets with more or fewer such light-emitting devices of given light-emitting wavelengths.

24. The centerpiece of claim 18, wherein the circuitry is configured further automatically to decouple power from the visible light regardless of the on-off status of the switch after a predetermined duration of time, thereby to preserve power.

25. The centerpiece of claim 24, wherein the body further includes a framed surface pocket configured securely to hold advertising or menu copy inserted therein.

26. The centerpiece of claim 25, wherein the base is equipped with standoffs to elevate the base slightly above the tabletop, and wherein the base, the body and the cover are configured and joined together collectively to form an enclosure that is substantially impervious to moisture from spilling or wiping.

* * * * *